US005343685A

United States Patent [19]

Burgermeister

[11] Patent Number: 5,343,685

[45] Date of Patent: Sep. 6, 1994

[54] MACHINE FRAME FOR A RING SPINNING OR RING TWISTING MACHINE

[75] Inventor: Horst Burgermeister, Geislingen/Steige, Fed. Rep. of Germany

[73] Assignee: Spindelfabrik Süussen, Schurr, Stahlecker & Grill GmbH, Fed. Rep. of Germany

[21] Appl. No.: 871,200

[22] Filed: Apr. 20, 1992

[30] Foreign Application Priority Data

Jul. 11, 1991 [DE] Fed. Rep. of Germany ..... 4122882

[51] Int. Cl.[5] ..... D01H 7/40

[52] U.S. Cl. ..... 57/136; 57/1 R

[58] Field of Search ..... 57/1 R, 136, 356, 354, 57/137, 122

[56] References Cited

U.S. PATENT DOCUMENTS

| | | | |
|---|---|---|---|
| 566,205 | 8/1896 | Martin et al. | 57/356 |
| 819,496 | 5/1906 | Allgood | 57/356 |
| 2,286,602 | 6/1942 | Cotchett | 57/137 |
| 2,658,327 | 11/1953 | Keyser | 57/136 |
| 2,758,439 | 8/1956 | Bradshaw | 57/136 |
| 2,923,119 | 2/1960 | Nifenecker | 57/1 R |
| 3,022,625 | 2/1962 | Meadows | 57/137 |
| 3,688,485 | 9/1972 | Lancaster | 57/1 R |
| 3,974,633 | 8/1976 | Clevenger | 57/1 R |
| 4,332,129 | 6/1982 | Schipper et al. | 57/1 R X |
| 4,735,039 | 4/1988 | Wunderlich | 57/136 X |
| 4,779,409 | 10/1988 | Marchiori et al. | 57/354 |

FOREIGN PATENT DOCUMENTS 0302161 2/1989 European Pat. Off. ..... 57/136

*Primary Examiner*—Clifford D. Crowder
*Assistant Examiner*—Larry D. Worrell, Jr.

[57] ABSTRACT

In the case of a machine frame for a ring spinning machine or a ring twisting machine, several vertical columns, which are situated opposite one another in pairs, are provided on each side of the machine distributed in the longitudinal direction of the machine. At the level of the spindle rails, the vertical columns are connected with one another by means of intermediate pieces extending transversely with respect to the longitudinal direction of the machine and, in the area of the upper ends, are connected with one another by means of transverse bridges. The intermediate pieces are used as the supporting elements for the spindle rails of both machine sides. The vertical columns are used as guiding elements for carriages of the ring rails as well as as guiding elements for carriages of yarn guides. With a self-guiding arrangement of the carriages, a lifting movement of the ring rails and of the yarn guides is ensured which is free of jerks and mutually independent. Recesses arranged on the ends of the intermediate pieces, into which the holders for the ring rail can be introduced, ensure that, while the overall height of the machine frame is low, a lifting movement of the ring rail is ensured between a lower winding area of the spindle and the upper end of the package sleeve.

19 Claims, 4 Drawing Sheets

MACHINE FRAME FOR A RING SPINNING OR RING TWISTING MACHINE

BACKGROUND AND SUMMARY OF THE INVENTION

This invention relates to a machine frame for a ring spinning or ring twisting machine for the holding of stationary spindle rails arranged on each side of the machine, with ring rails that can be moved up and down and with yarn guide rails that can also be moved up and down. Several vertical columns which are arranged on both sides of the machine opposite one another in pairs and are at least partially connected with one another by means of intermediate pieces which hold the spindle rails and extend transversely to the longitudinal direction of the machine. The vertical columns are used as guiding elements for holders for the ring rails and the yarn guide rails which can be vertically moved independently of one another.

In the case of a known construction for such a machine frame (European Patent Document EP-A 0 302 161), an intermediate stand is provided which is equipped with base parts and on which the spindle rails are fastened which extend in the longitudinal direction of the machine on both machine sides. On the intermediate stand, receiving devices are arranged for vertical columns which are situated opposite one another in pairs. For the ring rails, carriage-type holders are provided which are each connected by means of cross-struts with the holders situated on the opposite side of the machine and which are supported by means of guide rollers against the surfaces of the vertical columns which fate one another in each case. A drive is assigned to the holders which ensures the lifting movement of the ring rails.

In the case of another known construction, vertical columns, which are distributed on both sides of the machine in the longitudinal direction of the machine, are arranged on an intermediate frame which has base parts and on which the spindle rails are fastened. On the vertical columns, transverse bars are guided transversely to the longitudinal direction of the machine which are arranged above one another and on the mutually opposite ends of which ring rails, balloon limiting devices and yarn guides are arranged. For the guiding of the transverse bars, plastic sliders are provided in the area of the vertical columns.

In the case of another known machine frame which in principle has a construction that is similar to the above-described construction, the holders, which are connected with one another by means of transverse bars, are equipped with running rollers which are arranged to be vertically offset with respect to one another and rest against the vertical column.

In the case of the holders, which are connected with one another by means of transverse bars, it is possible that a jerky lifting movement of the ring rails or of the yarn guide rails may occur. This is observed particularly in the case of holders provided with plastic sliders. In comparison, the holders equipped with running rollers require more space. Thus several holders equipped with running rollers multiply the space requirement which, in the case of a certain overall height, limits the lifting movement of the lifting parts.

It is an object of the invention to develop a machine frame of the initially mentioned type in such a manner that a lifting movement of the ring rails and of the yarn guide rails is ensured that is mutually independent and not jerky, in which case, while the overall height is low, a lifting path of the ring rails between a lower winding area of the spindle and the upper end of the package tube is ensured. For achieving this object, it is suggested according to the invention that the holders are each arranged on the vertical columns in a self-guiding manner, and the intermediate piece is provided with recesses receiving the holders for the ring rail.

In the case of the development according to the invention, the mutually opposite holders are not connected with one another by means of transverse bars. As a result, a lifting movement of the holders is ensured that is not jerky because, as a result of the self-guiding arrangement, particularly a jamming of the holders is avoided. Furthermore, it is achieved by means of this development that, because of the absence of the transverse bars connecting the holders, the space in the machine center can be used for a different purpose. The holders for the ring rails which are arranged on one side of the machine are connected with one another by means of the ring rail. Also, the holders for the yarn guide rail which are disposed above these are connected with one another by means of these. The holders for the ring rail and for the yarn guide rail are each provided with a separate drive so that the ring rail and the yarn guide rail can carry out a lifting movement which is mutually independent. The recesses for the ring rail provided on the intermediate piece ensure that, while the overall height is low, the ring rail holders can carry out a maximum lifting travel. In particular, it is achieved in this manner that the ring rail can carry out a lifting movement between a lower winding area of the spindle and the upper end of the package sleeve. The increased space requirement for the self-guiding of the holders can therefore be compensated while the overall height remains the same.

In a further development of the invention, it is provided that the vertical columns are used as guiding elements for holders of balloon limiting rails which can be moved up and down. Thus, in a further development of the invention, three holders, which are arranged above one another, are guided on the vertical columns. In this case, the holder for the balloon limiting device or for the balloon limiting rail is advantageously arranged between the holder for the ring rail and the holder for the yarn limiting rail. A separate drive is also assigned to the holders for the balloon limiting rail and ensures a lifting movement that is independent of the other lifting elements.

In a further development of the invention, it is provided that the holders of the ring rails and/or of the balloon limiting rail and/or the yarn guiding rail are constructed as carriages guided on the vertical columns by means of rollers, in which case the carriages which follow one another in the longitudinal direction of the machine are connected with one another by means of the respective rails. In an expedient embodiment, it is provided that each carriage is provided with two rollers which are arranged to be vertically offset with respect to one another and to be laterally offset, the rollers which are in each case assigned to the rail being arranged in a deeper position. By means of such a roller guidance, a secure guiding is obtained on the vertical columns without the danger of a jamming or the like.

In a further development of the invention, the carriages are each provided with devices for the mounting of lifting drives on the sides which, with respect to the vertical columns are opposite the rails. The lifting drives are therefore applied to the carriages in such a manner that it is ensured that the rollers of the carriages always rest against the supporting columns.

In a further development of the invention, it is provided that the ring rail and/or the balloon limiting rail and/or the yarn guide rail are arranged in such a manner on the respective holders that, when the holders are guided together, a good approach of the ring rail and/or the balloon limiting rail and/or the yarn guide rail is ensured. In the case of an expedient embodiment, it is provided that the holders are provided with fastening elements which position the ring rail and/or the balloon limiting rail and/or the yarn guide rail in each case above the assigned holder. By means of such a fastening element for the yarn guide rail, it is achieved that this rail can be moved into the area of the delivery rollers of the drafting unit. Such a fastening element for the ring rail ensures that it can be moved into the upper end area of the package sleeve although, above the holder for the ring rail, the holders for the balloon limiting device and the yarn guide are arranged. By means of the recesses for the ring rail holders provided in the intermediate piece, it is achieved that, despite the ring rail arranged above the holders by means of the fastening elements, this ring rail can be moved into the lower winding area of the spindle.

In a further development of the invention, the recesses are arranged on oppositely arranged flanges for the fastening of the spindle rails. The dimensions of the recesses are adapted to the holders for the ring rails. Thus, their lowering into the recesses becomes possible. As a result, while the overall height of the machine frame is low, a maximal lifting path of the ring rail is ensured. In an advantageous further development, it is provided that the recess is bounded by wing-type perpendicularly aligned flange elements. The respective spindle rail is expediently fixed on the flange elements by means of screws.

In a further development of the invention, it is provided that the intermediate pieces are provided on both sides with receiving devices for the vertical columns. In this case, the inside diameter of the receiving devices is adapted to the outside diameter of the vertical columns.

In a further development of the invention, it is provided that mutually opposite vertical columns are at least partially connected in the area of their upper ends by means of transverse bridges. In the case of an expedient embodiment, it is provided that the intermediate pieces and/or the transverse bridges are manufactured as cast parts.

In another further development of the invention, it is provided that the vertical columns are at least partially constructed as supporting columns. Expediently, the supporting columns are provided with base parts. In the case of such a machine frame, the supporting columns represent an important structural element which takes over not only the support on the ground but also the guiding for the holders of the ring rails and other holders. Since the supporting columns have a simple, preferably cylindrical design, a simple but nevertheless stable construction of the machine frame may be realized.

Other objects, advantages and novel features of the present invention will become apparent from the following detailed description of the invention when considered in conjunction with the accompanying drawings.

DETAILED DESCRIPTION OF THE DRAWINGS

Figure 1:
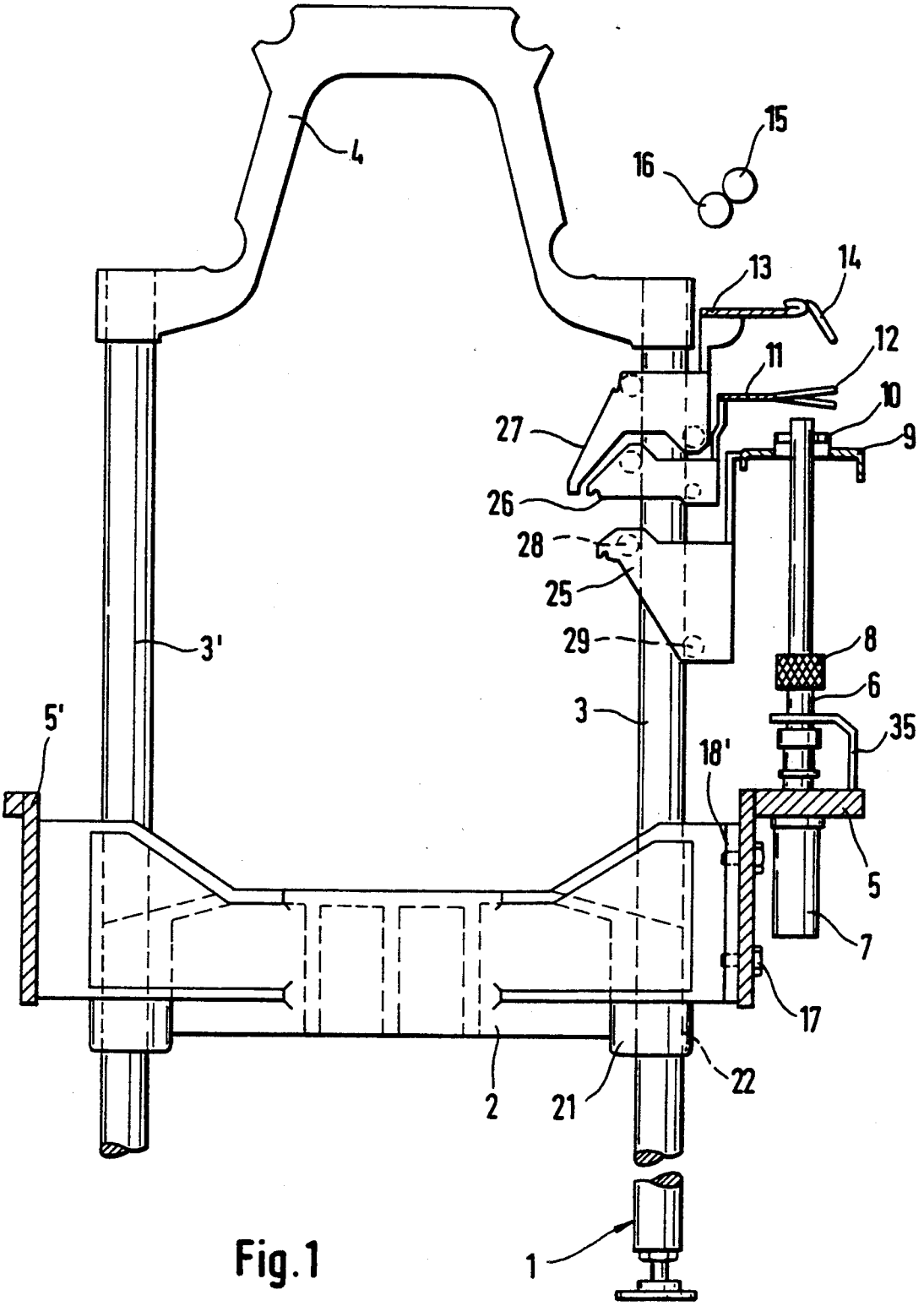
FIG. 1 is a partial cross-sectional view of a ring spinning machine constructed according to the invention.

The ring spinning machine illustrated only schematically in the drawing has a machine frame which comprises several supporting columns 3, 3' which are disposed opposite one another in pairs in a regularly spaced manner and which are, in each case, assigned to one side of the machine. The supporting columns 3, 3' are provided with base parts 1 which are preferably equipped with devices for the vertical adjustment. The supporting columns 3, 3' situated opposite one another in pairs are connected with one another by means of intermediate pieces 2 which are manufactured as cast pieces. The upper ends of the supporting columns 3, 3', which are disposed opposite one another in pairs, are connected with one another by means of transverse bridges 4 which are also manufactured as cast pieces. Two supporting columns 3, 3' one intermediate piece 2 and one transverse bridge 4, which is preferably also constructed as a cast piece, form a frame.

Spindle rails 5, 5' are mounted on the intermediate pieces 2 in each case on the outside at a distance from the supporting columns 3, 3' extend in the longitudinal direction of the machine and are composed of several segments. In this case, it is expediently provided that two segments of the spindle rails 5,5', which in each case, follow one another, are fastened on a common intermediate piece 2.

If ring spinning machines are involved, the transverse bridges 4 are used for receiving drafting units, of which only the delivery roller pair 15, 16 of one machine side is shown. These drafting units have elements which extend in the longitudinal direction of the machine, are also composed of sections and also contribute to the longitudinal reinforcement of the whole machine frame. In the case of a ring twisting machine, four delivery devices for the yarns to be twisted together are situated in the area of the transverse bridges 4.

In the spindle rails 5, 5', spinning or twisting spindles 6 with their bearing housings 7 are held at regular distances. The spinning or twisting spindles 6 receive package sleeves on which the fed yarn is wound by way of an urchin arrangement. Of this urchin arrangement, a ring rail 9 is shown which is equipped with rings 10 which each surround the spindle concentrically. The yarns are each fed by the delivery roller pairs 15, 16, in which case they travel through a yarn guide 14 arranged concentrically with respect to the spindles 6. Between the ring rail 9 and the yarn guides 14, balloon limiting devices 12 or balloon constricting rings are arranged. The spindles 6 are driven by tangential belts which are not shown in detail, extend in the longitudinal direction of the machine and are arranged below a covering 35 mounted on the spindle rail 5.

Figure 2:
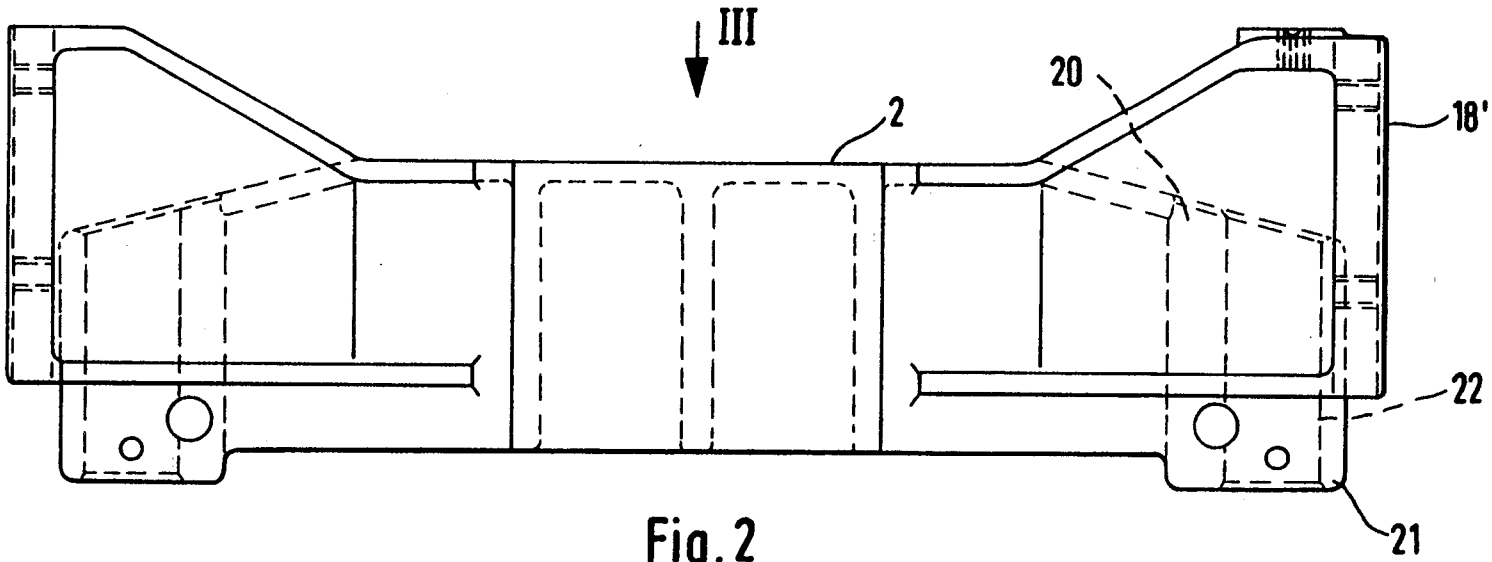
FIG. 2 is a side view of an intermediate piece of the machine frame according to FIG. 1.

The spindle rails 5 are each composed of a welded or rolled angle section which, by means of the respective vertical leg, is mounted on the intermediate pieces 2. The cast intermediate pieces 2 each have two mutually opposite receiving bores 22 for the supporting columns 3, 3'. The arrangement of the receiving bores 22 on the intermediate pieces 2 is particularly well illustrated in FIGS. 2 and 3. The perpendicularly aligned receiving bores 22 are disposed in projections 21 which are arranged on mutually opposite end areas of the intermediate pieces 2. The receiving bores 22 are adapted to the diameter of the supporting columns 3, 3'. In a manner not shown in detail, they are provided with clamping screws or the like so that their height on the supporting columns 3, 3' can be adjusted and fixed.

Figure 3:
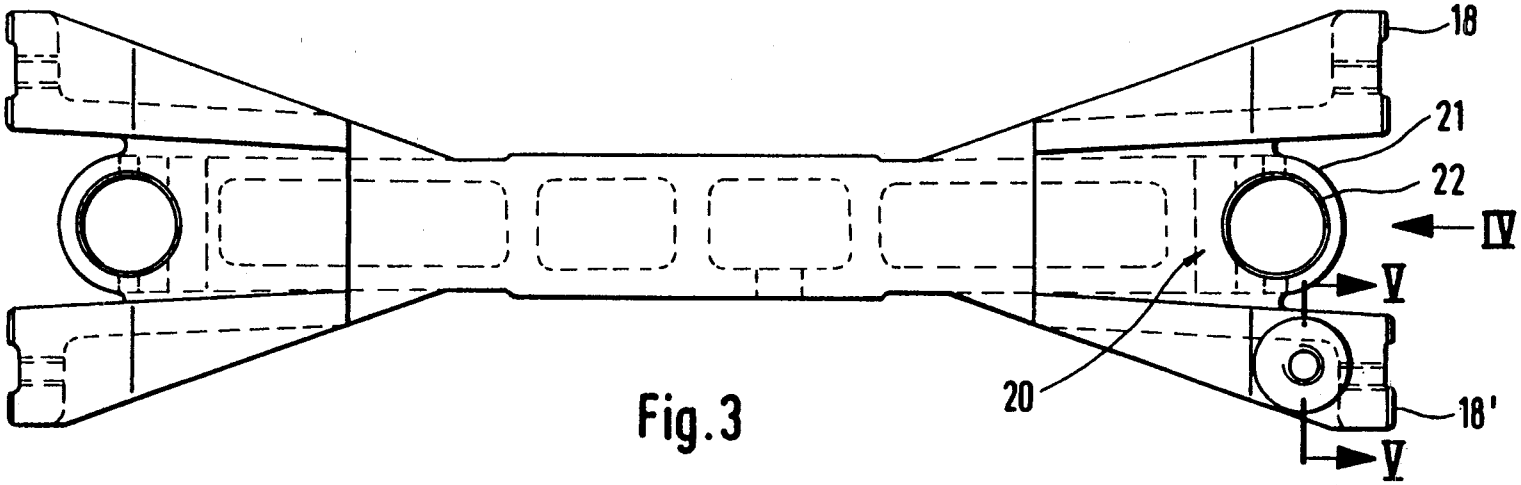
FIG. 3 is a top view in the direction of the arrow III according to FIG. 2.

As shown particularly in FIG. 3, the projections 21 are surrounded by two lateral wings which end in perpendicularly aligned flange elements 18, 18' to which the perpendicular legs of the spindle rails 5 are screwed by means of screws 17.

Figure 4:
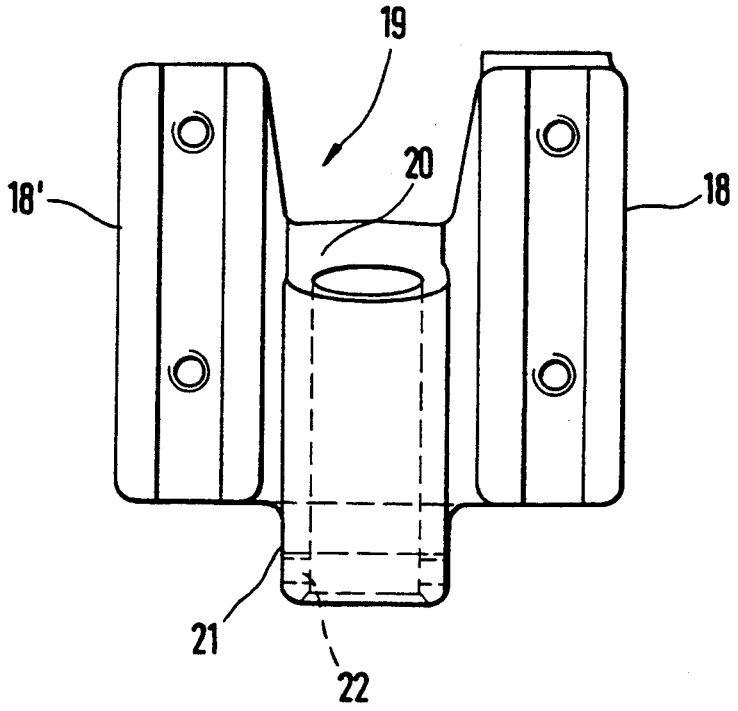
FIG. 4 is a view in the direction of the arrow IV according to FIG. 3.
Figure 5:
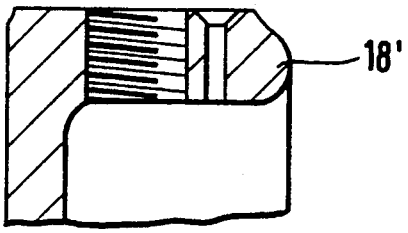
FIG. 5 is a sectional view along Line V—V according to FIG. 3.

As shown particularly in FIG. 4, which is a view in the direction of the arrow IV according to FIG. 3, the flange elements 18, 18' bound a recess 19, the significance of which will be understood on the basis of the following description. The projection 21 with the receiving bore 22 is displaced relatively downward with respect to the flange elements 18, 18. Thus, the height of the recess 19 is bounded by an obliquely extending surface 20.

Figure 6:
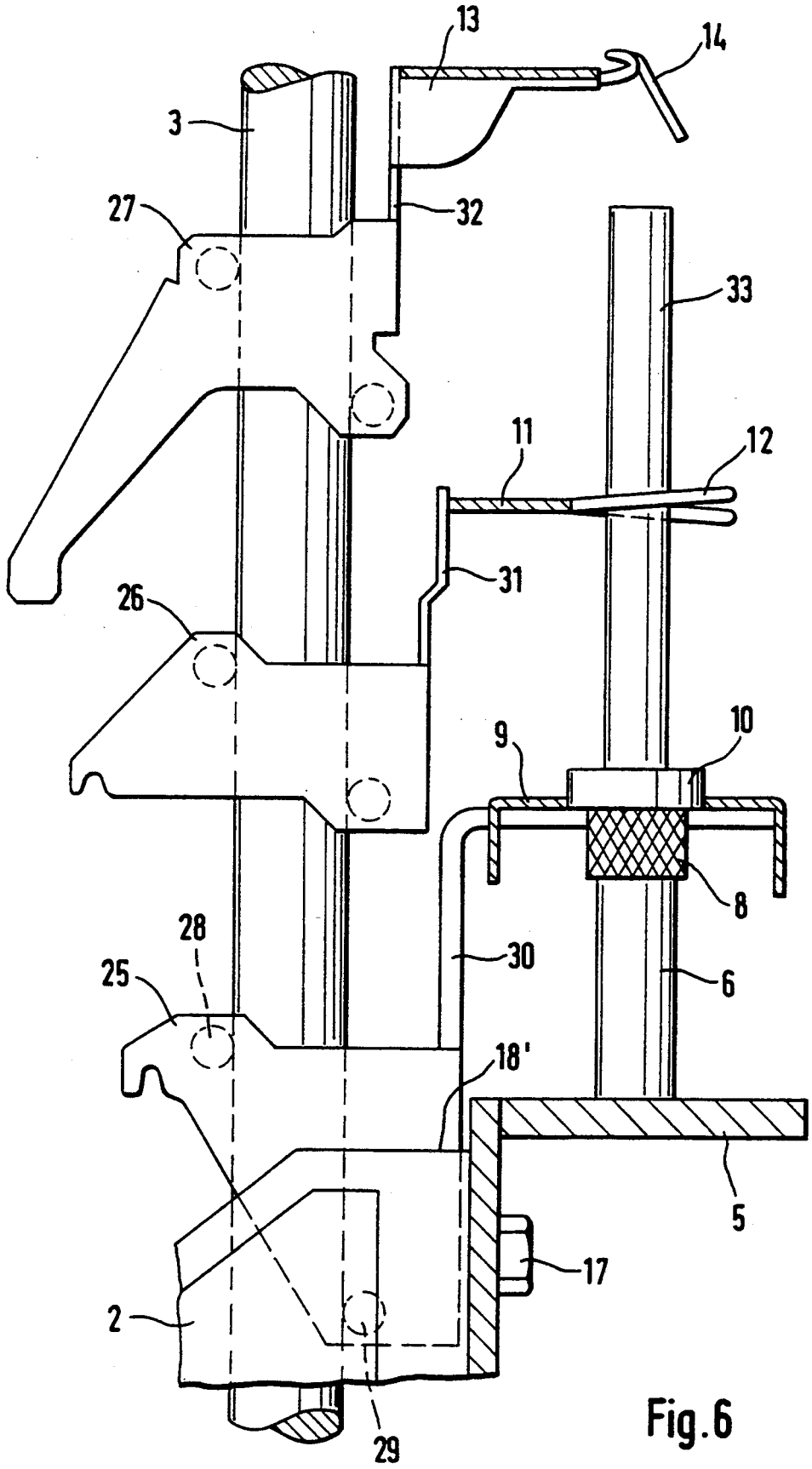
FIG. 6 is an enlarged partial cross-sectional view similar to FIG. 1.

The spindle rails 5, 5' are stationarily fastened to the intermediate pieces 2. However, the ring rails 9 carry out an up-and-down movement in order to obtain the desired winding form of the package, particularly a cop winding. For this purpose, the ring rails 9, starting on the lower end of the package sleeve, carry out an up-and-down movement of a given height which is superposed by an additional lifting movement by means of which the ring rail 9 is gradually disposed toward the top to the end of the package sleeve until the package construction is concluded in the end position shown in FIG. 1. Then the ring rail 9 is moved down again to a lower winding area 8 of the spindle on which lower windings are deposited (FIG. 6). Similar movements are also carried out by the balloon limiting devices 12 and the yarn guides 14, their paths being shorter, however. They therefore move at lower speeds, while, however, the upper and lower reversing points are reached synchronously. The up-and-down movements and the superposed lifting movements are carried out by known drives which are not shown.

In order to permit the up-and-down movements and the superposed lifting movement, the ring rails 9 are guided by means of carriages 25 on the supporting columns 3,3' serving as guiding elements. The carriages 25 are provided with two vertically offset and laterally offset rollers 28, 29, the lower situated roller 29 being arranged on the side of the ring rails 9 so that the torque caused by the inherent weight causes a contact of the rollers 28, 29. On the side that is situated opposite the ring rails 9, the carriages 25 are equipped with hook-shaped devices for the connecting of the lifting drive. Likewise, the holders for the ring rail 5' arranged on the opposite supporting column 3' are provided with a separate lifting drive.

In a corresponding manner, the balloon limiting devices 12 and the yarn guides 14 are equipped with carriages 26, 27 which are also guided on the supporting columns 3, 3' serving as the guiding elements. Similar to the holder 25, the carriages 26, 27 are also equipped with rollers which are offset vertically. As illustrated in FIGS. 1 and 6, the carriage 25 of the ring rail 9—viewed in the longitudinal direction of the machine—is wider than the carriage 26 of the balloon limiting devices 12 which, in turn, is wider than the carriage 27 of the yarn guide 14.

The carriages 25, 26, 27 are each equipped with upwardly projecting fastening elements 30, 31, 32 which respectively hold the ring rail 9, a balloon limiting rail 11 extending in the longitudinal direction of the machine, and a yarn guide rail 13. The fastening elements 30 of the ring rail 9 have a larger height than the fastening elements 31 of the balloon limiting rail 11, and these, in turn, have a larger height than the fastening elements 32 of the yarn guide rail 13. As a result, it is possible to move the ring rail 9, the balloon limiting device 12 and the yarn guides 14 relatively close together in the end position (FIG. 1), in which case, in addition, only a relatively low vertical height of the supporting columns 3, 3' is required. As also shown in this end position, it is possible to move the yarn guides 14 by means of the fastening element 32 into the area of the delivery rollers 15, 16 of the drafting unit which is not shown in detail.

The recesses 19, which are provided in the intermediate supports 2, permit that the lower area of the carriage 25 of the ring rail 9 fits into the area of the recess 19 so that this carriage 25 with the ring rail 9 can be moved relatively far downward (FIG. 6), while, nevertheless, in the vertical direction, relatively small dimensions are required for the machine frame. The recesses 19 are provided substantially adjacent the vertical columns at the upper surface of the intermediate supports 2. In this lower end position of the lifting movement of the carriage 25, the ring rail 9, as shown in FIG. 6, is arranged in the lower winding area 8 of the spindle 6.

The carriages 25, 26, 27 which follow one another in the longitudinal direction of the machine are connected with one another by the ring rail 9 or the rails 11, 13 so that there necessarily is an alignment. In this case, it may expediently be provided that also the rails 9, 11, 13 are divided into sections in the longitudinal direction of the machine, in which case the ends of respective successive sections are mounted on a common carriage 25, 26, 27.

As illustrated particularly in FIG. 1, the center area of the machine frame is free between the supporting columns 3, 3' because it is not required for the guides of the ring rail 9, of the balloon limiting devices 12 and of the yarn guides. The driving elements for the spindles 6 as well as the driving elements for the carriages 25, 26, 27 can therefore easily be housed in this center area. In addition, there will then still be sufficient space for other elements extending through in the longitudinal direction of the machine, particularly for drive shafts or vacuum ducts or the like.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A machine frame for a ring spinning machine having on each side stationary spindle rails, ring rails that can be moved up and down and yarn guide rails that can also be moved up and down, the machine frame comprising:

a plurality of vertical supporting columns that extend to a floor surface and support the spindle rails of the machine, and which are arranged on each side of the machine opposite one another in pairs, intermediate pieces for connecting the vertical columns with one another, said intermediate pieces holding the spindle rails of the machine and extending transversely to the longitudinal direction of the machine, ring rail holders for holding the ring rails of the machine, and yarn guide rail holders for holding the yarn guide rails of the machine, wherein the ring rail holders and yarn guide rail holders are coupled to the vertical columns so as to be guidingly vertically movable on the vertical columns independently of one another, and wherein the intermediate pieces have recesses substantially adjacent said vertical columns at the upper surface of said intermediate pieces for accommodating the ring rail holders when said ring rail holders are moved downward to the spindle rails of the machine.

2. A machine frame for a ring spinning machine having on each side stationary spindle rails, ring rails that can be moved up and down and yarn guide rails that can also be moved up and down, the machine frame comprising:

a plurality of vertical supporting columns that extend to a floor surface and support the spindle rails of the machine, and which are arranged on each side of the machine opposite one another in pairs, intermediate pieces for connecting the vertical columns with one another, said intermediate pieces holding the spindle rails of the machine and extending transversely to the longitudinal direction of the machine.

ring rail holders for holding the ring rails of the machine, a roller guide having rollers offset with respect to height and riding on the vertical columns, the roller guide being coupled to the ring rail holders to provide guided vertical movement of the ring rail holders on the vertical columns, and yarn guide rail holders, guidingly vertically movably coupled to the vertical columns, for holding the yarn guide rails of the machine, wherein the yarn guide rail holders and the ring rail holders are movable on the vertical columns independently of one another, and wherein the intermediate pieces have recesses substantially adjacent said vertical columns at the upper surface of said intermediate pieces for accommodating the ring rail holders when said ring rail holders are moved downward to the spindle rails of the machine.

3. A machine frame according to claim 1, further comprising balloon limiting rails coupled to the vertical columns so as to be guidingly vertically movable on the vertical columns.

4. A machine frame according to claim 3, wherein at least one of the ring rail holders, yarn guide rail holders, and balloon limiting rail holders are carriages guided on the vertical columns by rollers, the carriages which follow one another in the longitudinal direction of the machine being connected with one another by the respective rails.

5. A machine frame according to claim 4, wherein each carriage is provided with two rollers which are at least one of vertically offset and laterally offset with respect to one another, the rollers which in each case are arranged on the side of the rails being arranged lower on the vertical column.

6. A machine frame according to claim 4, wherein the carriages include devices for the mounting of lifting drives on the sides that are in each case opposite the rails with respect to the vertical columns.

7. A machine frame according to claim 3, wherein at least two vertically adjacent sets of ring, yarn guide, and balloon limiting rail holders have portions which overlap to thereby allow close approaches of the rails during operating movements thereof.

8. A machine frame according to claim 7, wherein each of the ring rail, yarn guide rail, and balloon limiting rail holders include fastening elements that secure the position of the ring rail, balloon limiting rail, and yarn guide rail respectively above the ring rail holder, the yarn guide rail holder and the balloon limiting rail holder.

9. A machine frame according to claim 1, wherein the intermediate pieces have oppositely arranged flanges for the fastening of the respective associated spindle rails and the recesses are between the oppositely arranged flanges.

10. A machine from according to claim 7, wherein the oppositely arranged flanges include wing-type flange elements perpendicularly aligned with respect to the longitudinal axes of the intermediate pieces, wherein the recesses are between the wing-type flange elements.

11. A machine frame according to claim 1, wherein the intermediate prices have two ends, with each end having a receiving device for the vertical columns.

12. A machine frame according to claim 1, wherein mutually opposite vertical columns are connected in the area of their upper ends by means of transverse bridges.

13. A machine frame according to claim 12, wherein at least one of the intermediate pieces and the transverse bridges is a cast part.

14. A machine frame according to claim 1, wherein the vertical columns at least partially are supporting columns.

15. A machine frame according to claim 14, wherein the supporting columns have base parts.

16. A machine frame according to claim 4, wherein each of the rail holders is one of the carriages guided on the vertical column by means of rollers.

17. A machine frame according to claim 7, wherein each of the rail holders have portions which overlap with a vertically adjacent holder to thereby allow close approach of the rails during operating movement thereof.

18. A machine frame according to claim 4, wherein at least two vertically adjacent sets of ring, yarn guide, and balloon limiting rail holders that overlap to thereby close approaches of the rails during operating movements thereof.

19. A machine frame according to claim 16, wherein each of the rail holders have portions that overlap with a vertically adjacent holder to thereby allow close approach of the rails during operating movement thereof.

* * * * *